United States Patent [19]

Bean

[11] 4,105,320

[45] Aug. 8, 1978

[54] TRANSFER OF CONDUCTIVE PARTICLES

[75] Inventor: Lloyd F. Bean, Rochester, N.Y.

[73] Assignee: Xerox Corporation, Stamford, Conn.

[21] Appl. No.: 757,106

[22] Filed: Jan. 5, 1977

[51] Int. Cl.[2] ..... G03G 15/00

[52] U.S. Cl. ..... 355/3 TR; 101/DIG. 13

[58] Field of Search ..... 355/3 R, 3 DD, 3 TR; 101/DIG. 13

[56] References Cited

U.S. PATENT DOCUMENTS

| | | | |
|---|---|---|---|
| 3,684,364 | 8/1972 | Schmidlin | 355/3 R X |
| 3,795,441 | 3/1974 | Hoffman et al. | 355/3 TR |
| 3,847,478 | 11/1974 | Young | 355/3 TR |
| 3,860,857 | 1/1975 | Namiki et al. | 355/3 TR X |
| 3,912,387 | 10/1975 | Brooke | 355/3 R |
| 3,924,943 | 12/1975 | Fletcher | 355/3 TR |
| 3,936,174 | 2/1976 | Carpenter | 355/3 TR |
| 3,966,199 | 6/1976 | Silverberg | 355/3 TR X |

OTHER PUBLICATIONS

Fletcher et al., "High Frequency Pulsed Bias Roller Transfer System," Xerox Disclosure Journal, vol. 1, No. 5, p. 83, May 1976.

*Primary Examiner*—Fred L. Braun

*Attorney, Agent, or Firm*—J. J. Ralabate; C. A. Green; H. Fleischer

[57] ABSTRACT

A reproducing machine in which a particle receiving member has charged conductive particles deposited thereon in image configuration. The particles are transferred from the receiving member to a copy sheet with the charge exchanged between the particles and the sheet being controlled to prevent repulsion of the particles from the sheet during the transfer of the particles thereto.

16 Claims, 7 Drawing Figures

TRANSFER OF CONDUCTIVE PARTICLES

BACKGROUND OF THE INVENTION

This invention relates generally to a reproducing machine, and more particularly concerns the transfer of charged conductive particles from a latent image to a copy sheet.

Though there are various types of reproducing machines, the most commonly available are electrostatographic printing machines. In an electrostatographic printing machine, a latent image is recorded on a surface and rendered visible with particles. These particles may be transferred to a sheet of support material, in image configuration, or remain on the recording surface. In either case, the particles are permanently affixed to the sheet of support material or recording surface. In this manner, a copy of an original document is formed. Electrostatographic printing includes both electrophotographic and electrographic printing. Electrophotographic printing employs a light image of the original document to dissipate a charged photoconductive surface. This results in a latent image of the original document being recorded on the photoconductive surface. Electrographic printing does not employ a photoconductive member or a light image to create a latent image of the original document. In general, both of the foregoing processes employ heat-settable particles to develop the latent image. These are permanently affixed to the copy sheet by the application of heat hereto.

Typically, the developer material employed in an electrophotographic printing machine is a two-component mixture, i.e. a mixture of carrier granules and toner particles. Toner particles adhere triboelectrically to the carrier granules and, during the development process, are attracted from the carrier granules to the latent image. Typical toner particles used in a developer mix of this type have resistivities ranging from about $10^{14}$ to about $10^{17}$ ohm-cm. Generally, toner particles of this type are transferred from the latent image to a copy sheet by the application of a field across the photoconductive member-toner particles-copy sheet sandwich. In this way, the toner particles are attracted from the latent image to the copy sheet.

With the advent of single component developer materials, i.e. charged conductive particles, carrier granules are no longer required. However, the charged conductive particles employed in a single component system have low resistivities which range from about $10^4$ to about $10^9$ ohm-cm. These particles are also developed on the latent image recorded on the photoconductive member. However, when particles of this type are transferred from the latent image to the copy sheet, repulsion occurs. Repulsion is due to both the copy sheet and the charged conductive toner particles having relaxation times which are considerably shorter than the transfer time. This allows the charged conductive particles to exchange charge with the copy sheet, i.e. from positive charge to a negative charge, or vice versa.

Many different types of systems have been devised for improving both development and transfer of toner particles to the copy sheet. Exemplary of these are U.S. Pat. No. 3,882,822, issued to Sullivan, Jr. in 1975 and U.S. Pat. No. 3,676,533 issued to Gundlach, in 1971. Both of the foregoing patents appear to disclose a relatively narrow contact between the photoconductive surface and the copy sheet when compared to the development zone. U.S. Pat. No. 3,929,098 issued to Liebman in 1975 discloses the use of a corona generating device for spraying ions onto the backside of the copy sheet. The corona generating device appears to be located midway between the exit and entrance zones of the transfer station. In this way, toner particles are transferred from the photoconductive member to the copy sheet. Similarly, U.S. Pat. No. 3,881,927 issued to Fantuzzo in 1975 discloses a transfer station incorporating a wide transfer sheet contact zone with the photoconductive member in combination with a corona generating device disposed midway therebetween. U.S. Pat. No. 3,759,222 issued to Maksymiak et al in 1973 discloses the use of an alternating field to minimize charge buildup at dielectric interfaces. In addition, Xerox Disclosure Journal, Volume 1, Number 5, of May 1976, page 83, discloses a high frequency pulsed bias roll transfer system. The pulsing frequency is greater than the time constant of the copy sheet so that the applied transfer charge does not have sufficient time to dissipate. U.S. Pat. No. 3,147,679 issued to Schaffert in 1964 teaches the use of conductive rollers which urge the copy sheet into contact with the photoconductive drum. These rollers have at least peripheral conductive surface elements. The rollers are electrically insulated from the remainder of the transfer structure and have a polarity which aids and opposes charge transfer. However, none of the foregoing references appear to disclose a system wherein a single component developer material utilizing charged conductive particles is employed with the toner particles prevented from being repelled from the copy sheet.

Accordingly, it is a primary object of the present invention to improve electrophotographic printing to prevent the repulsion of charged conductive particles from the copy sheet.

SUMMARY OF THE INVENTION

Briefly stated and in accordance with the present invention, there is provided a reproducing machine.

Pursuant to the features of the present invention, the reproducing machine includes a particle receiving member. Means are provided for depositing charged particles on the receiving member, in image configuration. Means transfer the particles from the receiving member to a copy sheet. The charge exchange between the particles and the sheet is controlled to prevent replusion of the particles from the sheet during the transfer of the particles thereto.

BRIEF DESCRIPTION OF THE DRAWINGS

Other objects and advantages of the present invention will become apparent upon a reading of the following detailed description and upon reference to the drawings, in which.

While the present invention will hereinafter be described in connection with numerous embodiments, it will be understood that it is not intended to limit the invention to these embodiments. On the contrary, it is intended to cover all alternatives, modifications and equivalents as may be included within the spirit and scope of the invention as defined by the appended claims.

DETAILED DESCRIPTION OF THE INVENTION

Figure 1:
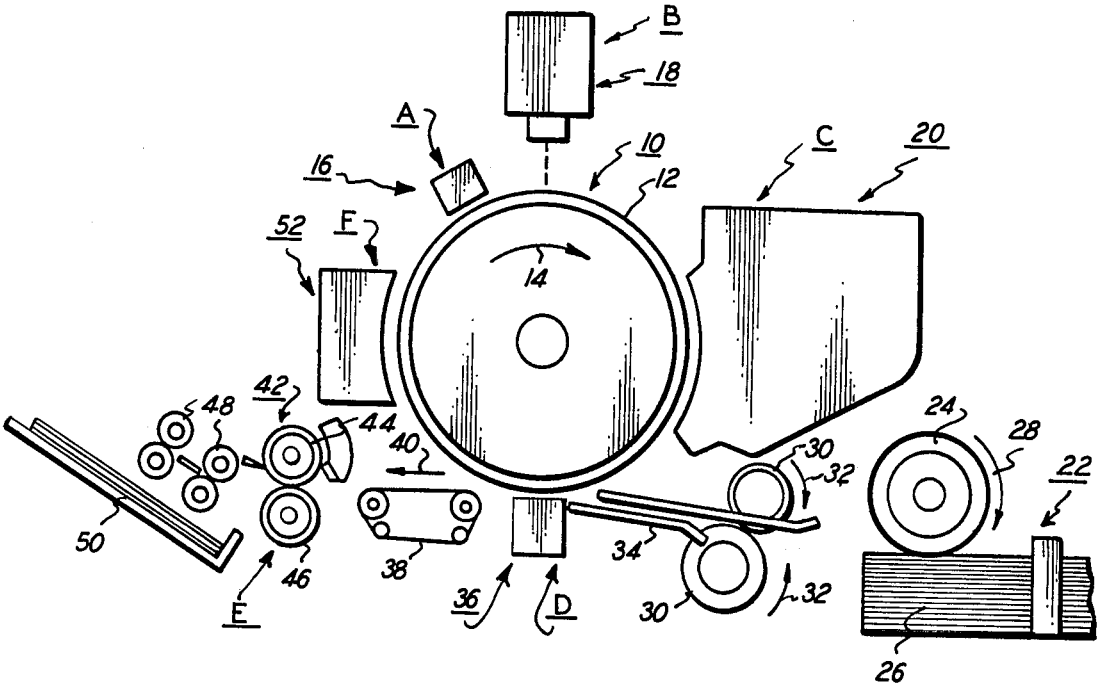
FIG. 1 illustrates an electrophotographic printing machine incorporating the features of the present invention therein.

For a general understanding of an electrophotographic printing machine in which the features of the present invention may be incorporated, reference is had to FIG. 1 which depicts schematically the various components thereof. In the drawings, like reference numerals have been employed throughout to designate identical elements. Although the various transfer systems disclosed herein are particularly well adapted for use in the FIG. 1 electrophotographic printing machine, it will become evident from the following discussion that they are equally well suited for use in a wide variety of electrostatographic printing machines and are not necessarily limited in their application to the particular embodiments shown herein.

Inasmuch as the practice of electrophotographic printing is well known in the art, the various processing stations for producing a copy of an original document will be represented schematically in FIG. 1.

Referring now to FIG. 1, the electrophotographic printing machine employs a drum 10 having a photoconductive surface 12 entrained about and secured to the exterior circumferential surface thereof. Drum 10 rotates in the direction of arrow 14 to pass through the various processing stations located about the periphery thereof. A suitable photoconductive material may be a selenium alloy of the type described in U.S. Pat. No. 2,970,906 issued to Bixby in 1971.

Initially, drum 10 rotates a portion of photoconductive surface 12 to charging station A. At charging station A, a corona generating device, indicated generally by the reference numeral 16, charges at least a portion of photoconductive surface 12 to a relatively high substantially uniform potential. One type of suitable corona generating device is described in U.S. Pat. No. 2,836,725, issued to Vyverberg in 1958.

Thereafter, the charged portion of photoconductive surface 12 rotates to exposure station B. Exposure station B includes an exposure mechanism, indicated generally by the reference numeral 18. Exposure mechanism 18 includes a stationary housing comprising a transparent platen, such as a glass plate or the like, arranged to support an original document thereon. Lamps illuminate the original document. Scanning of the original document is achieved by oscillating a mirror in a timed relationship with the movement of drum 10, or by translating the lamp and lens system across the original document to create successive incremental light images. These light images are projected, in a timed relationship, onto the charged portion of photoconductive surface 12. In this manner, the light image of the original document irradiates the charged photoconductive surface dissipating selectively the charge thereon. This records an electrostatic latent image corresponding to the informational areas contained within the original document.

After the electrostatic latent image is recorded on photoconductive surface 12, drum 10 rotates to development station C. At development station C, developer unit 20 brings developer material into contact with the electrostatic latent image. One type of development system is depicted schematically in FIG. 2. In general, developer unit 20 employs a magnetic brush development system wherein the developer material is brought through a directional flux field forming a brush thereon. The brush of developer material contacts the electrostatic latent image recorded on photoconductive surface 12. The development system employs a single component developer material which comprises charged magnetic particles. Such as fine grained ferromagnetic materials.

Prior to proceeding with the remaining processing stations, the sheet feeding apparatus will be briefly described. Sheet feeding mechanism 22 advances a sheet of support material, in synchronism with the rotation of drum 10, to transfer station D. Sheet feeding mechanism 22 includes feed roll 24 in contact with the uppermost sheet of stack 26. Feed roll 24, rotating in the direction of arrow 28, advances successive uppermost sheets from stack 26. Registration rolls 30, rotating in the direction of arrow 32, align and forward the advancing sheet into chute 34. Chute 34 directs the sheet into contact with photoconductive surface 12, in registration with the particles deposited thereon in image configuration. Hence, the sheet of support material contacts the particle image at transfer station D.

Transfer station D includes a transfer mechanism indicated generally by the reference numeral 36. Hereinafter, various embodiments of this transfer system will be discussed with reference to FIGS. 2 through 8, inclusive. In general, transfer mechanism 36 affects the transfer of the charged particles from photoconductive surface 12 to the copy sheet without the particles being repelled therefrom. After transferring the charged particles to the sheet of support material, endless belt conveyer 38 advances the sheet of support material, in the direction of arrow 40, to fusing station E.

Fusing station E includes a fuser assembly, indicated generally by the reference numeral 42. Fuser assembly 42 heats the transferred particles to permanently affix them to the sheet of support material. A heated fuser roller 44 cooperates with a backup roll 46 to define a nip through which the sheet of support material passes. The sheet of support material passes through the nip with the particle image thereon contacting fuser roll 44.

After the particle image is permanently affixed to the sheet of support material, the sheet of support material is advanced by a series of rollers 48 to catch tray 50 for subsequent removal therefrom by the machine operator.

Invariably, after the sheet of support material is separated from photoconductive surface 12, some residual particles remain adhering thereto. These residual particles are removed from photoconductive surface 12 at cleaning station F. Cleaning station F includes a cleaning mechanism, designated generally by the reference numeral 52. The particles are cleaned from photoconductive surface 12 by a rotatably mounted fibrous brush in contact therewith.

After cleaning, a discharge lamp floods photoconductive surface 12 with light to dissipate any residual charge thereon. Thus, the charge on photoconductive surface 12 is returned to its initial level prior to the recharging thereof.

It is believed that the foregoing description is sufficient for purposes of the present application to illustrate the general operation of an electrophotographic printing machine incorporating the features of the present invention therein.

Referring now to the specific subject matter of the present invention, FIGS. 2 through 5, inclusive, describe alternate embodiments for decreasing the transfer time and increasing the development time such that the development time exceeds the transfer time. This prevents charge exchange from occurring between the charged conductive particles and the copy sheet during the transfer period.

Figure 2:
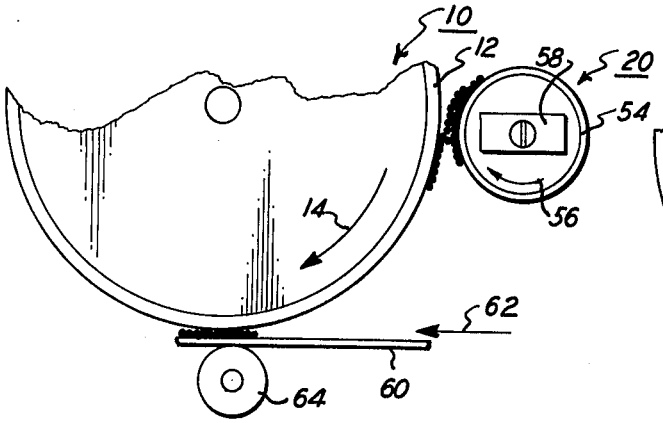
FIG. 2 depicts one embodiment of the development station and transfer station employed in the FIG. 1 printing machine.

Referring now to FIG. 2, there is shown developer unit 20 employing a magnetic brush system. Developer unit 20 comprises an exterior tubular member 54 having the exterior circumferential surface thereof roughened. Preferably, tubular member 54 is made from a non-magnetic material such as aluminum. Tubular member 54 rotates in the direction of arrow 56. Magnet 58 is disposed interiorly of tubular member 54 and mounted stationarily therein. As drum 10 rotates in the direction of arrow 14, the electrostatic latent image recorded on photoconductive surface 12 attracts the charged conductive particles from tubular member 54 thereto. Thereafter, drum 10 rotates the charged particles, in image configuration, to transfer apparatus 36. The copy sheet or sheet of support material 60 moves in the direction of arrow 62 and is interposed between photoconductive drum 10 and transfer roller 64. Transfer roller 64 is electrically biased to a suitable potential and polarity so as to attract the charged conductive particles from the electrostatic latent image recorded on photoconductive surface 12 of drum 10 to copy sheet 60. Transfer roller 64 is preferably made from a metal roller having a resilient layer entrained thereabout. By way of example, the resilient layer may be urethane. The transfer zone is smaller than the development zone. Thus, the transfer time is less than the development time. This is achieved by roller 64 having a diameter less than tubular member 54. This insures that charge exchange does not occur between copy sheet 60 and the charged conductive particle being transferred. In this way, repulsion of the charged particles from the copy sheet is prevented.

Figure 3:
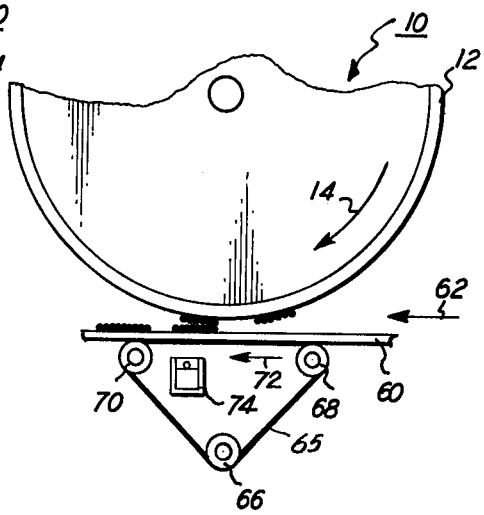
FIG. 3 shows another embodiment of the transfer station utilized in the FIG. 1 printing machine.

Turning now to FIG. 3, another embodiment of transfer station D is depicted therein. Once again, this transfer apparatus will also have a smaller transfer zone than development zone. Thus, the transfer time will be less than the development time and charge exchange between the copy sheet and charged conductive particles will be prevented. As shown in FIG. 3, copy sheet 60 advances in the direction of arrow 62. A porous conveyor belt 65 advances copy sheet in the direction of arrow 62. Belt 65 is entrained about a plurality of spaced rollers 66, 68 and 70. A suitable motor (not shown) rotates roller 68 so as to advance belt 65 in the direction of arrow 72. Corona generator 74 sprays ions through belt 64 onto the backside of copy sheet 60. Corona generator 74 is positioned a short distance prior to the location wherein copy sheet 60 is separated from photoconductive surface 12 of drum 10. In this way, the transfer zone is smaller than the development zone. Once again, this process also prevents charge exchange between the charged conductive particles being transferred to the copy sheet and the copy sheet.

Figure 4:
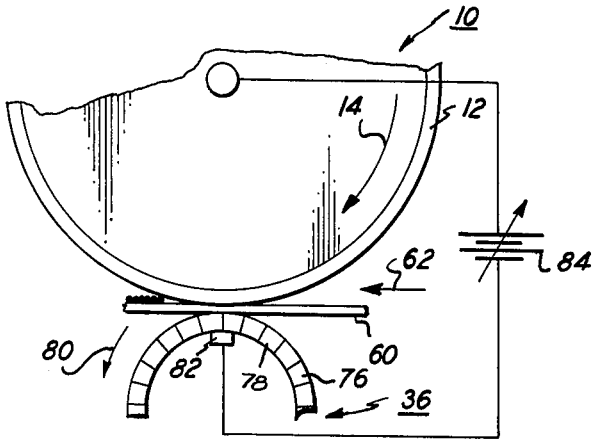
FIG. 4 illustrates another embodiment of the transfer station used in the FIG. 1 printing machine.

Referring now to FIG. 4, there is shown still another embodiment wherein the transfer zone is smaller than the development zone. As depicted therein, transfer apparatus 36 comprises a transfer roller 76 (shown fragmentarily) having a plurality of electrically conductive segments 78. Each segment is insulated from adjacent segments. Transfer roller 76 rotates in the direction of arrow 80. Brush 82 contacts successive segments 78 and transfer roller 76 rotates in the direction of arrow 82. The width of each segment 78 is less than the development zone. In this way, the transfer zone is maintained smaller than the development zone. This insures that the transfer time is less than the development time. Voltage source 84 is electrically coupled to the corresponding segment via brush 82. In this way, each segment is electrically biased in the proper polarity and magnitude to attract the charged conductive particles from the electrostatic latent image recorded on photoconductive surface 12 of drum 10. Inasmuch as the transfer zone is less than the development zone, the charged particles are transferred from the electrostatic latent image to the copy sheet 60 with a minimim amount of charge exchange occurring. In this way, repulsion of the charged conductive particles from the copy sheet is prevented.

Figure 5:
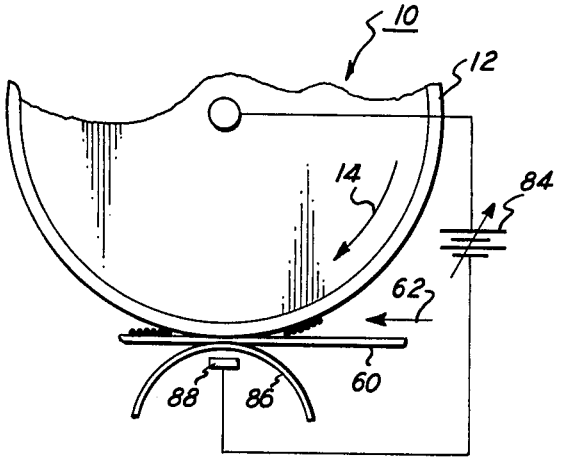
FIG. 5 shows another embodiment of the transfer station employed in the FIG. 1 printing machine.

Referring now to FIG. 5, there is shown still another embodiment of transfer apparatus 36 wherein the transfer zone is less than the development zone. As depicted therein, transfer apparatus 36 includes a tubular member 86, shown fragmentarily. An electrically conductive shoe 88 is disposed closely adjacent to the interior circumferential surface of tubular member 86. The width of shoe 88 is less than the development zone. Voltage source 84 electrically biases shoe 88 to the proper magnitude and polarity so as to attract charged particles from the electrostatic latent image recorded on photoconductive surface 12 of drum 10. Inasmuch as the transfer zone is defined by the width of shoe 88, and shoe 88 is smaller than the development zone, the transfer zone is smaller than the development zone. Thus, the transfer time is less than the development time and little or no charge exchange occurs between the conductive particles and copy sheet 60 during the transfer process. Copy sheet 60 does not repel the conductive particles being transferred thereto and charged particles are transferred to copy sheet 60 in image configuration.

Figure 6:
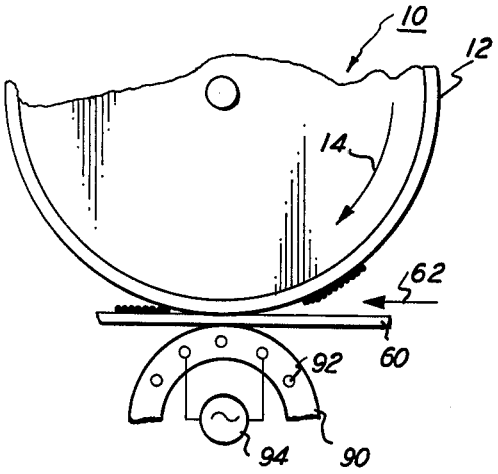
FIG. 6 depicts another embodiment of the transfer station utilized in the FIG. 1 printing machine.

Another approach for preventing the repulsion phenomenon is by using dielectric forces, i.e. alternating convergent electric fields. The dielectric forces attracts the charge particles from the latent image to the copy sheet. The period of the alternating convergent electric field must be shorter than the relaxation time of the copy sheet. However, for maximum dielectric attraction, the period of the alternating convergent electric field must be greater than the relaxation time of the charged conductive particles. These constraints define the bounds of the time period for the alternating convergent electric field signal. Preferably, the time period of the alternating convergent electric field must lie between $3 \times 10^{-9}$ seconds and $3 \times 10^{-2}$ seconds. FIG 6 depicts one embodiment of a dielectric transfer roll configuration. As depicted therein, transfer apparatus 36 includes a transfer roller 90 formed from a tubular member preferably made from a resilient material such as urethane. Tubular member 90 comprises a plurality of spaced conductive rods 92 extending the entire length thereof. Voltage source 94, connected to rods 92, develops an AC voltage. In this way, an alternating convergent electric field is established which produces dielectric forces for attracting the charged conductive particles from the electrostatic latent image recorded on photoconductive surface 12 of drum 10 to copy sheet 60. It should be noted that copy sheet 60 moves in the direction of arrow 62 and is interposed between transfer roller 90 and drum 10. Voltage source 94 has a time period which lies between $3 \times 10^{-9}$ seconds and $3 \times 10^{-2}$ seconds. In this manner, the period of the alternating convergent electric field is shorter than the relaxation time of copy sheet 60. In addition, the period of the convergent electric field is greater than the relaxation time of the charged conductive particles. Thus, repulsion of the charged conductive particles from copy sheet 60 is prevented.

Figure 7:
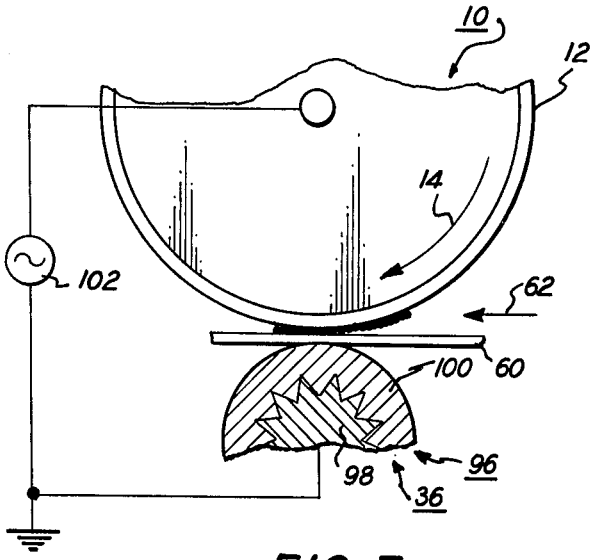
FIG. 7 illustrates another embodiment of the transfer station used in the FIG. 1 printing machine.

FIG. 7 depicts an alternate dielectric transfer roll configuration. As shown therein, transfer apparatus 36 includes a transfer roll 96. Transfer roll 96 includes an interior cylindrical roller 98 having the exterior circumferential surface thereof roughened. A resilient coating 100 is secured to the exterior circumferential surface of roller 98. Preferably, resilient layer 100 is made from urethane. Similarly, cylindrical roller 98 is made from a metal. Voltage source 102 electrically biases cylinder 98. Voltage source 102 develops an AC voltage having a time period between $3 \times 10^{-9}$ seconds and $3 \times 10^{-2}$ seconds. Thus, the time period of the alternating convergent electric field is less than the relaxation time of copy sheet 60 and greater than the relaxation time of the charged conductive particles. This prevents copy sheet 60 from repelling the charged conductive particles being transferred thereto from the electrostatic latent image recorded on photoconductive surface 12.

In recapitulation, various systems have been described which prevent repulsion of the charged conductive particles from the copy sheet during the transfer process. In this way, the charged conductive particles are transferred to the copy sheet in image configuration. These embodiments include systems which decrease the transfer period and/or increase the development time such that the development time exceeds the transfer time. This prevents the charge conductive particles from exchanging charge with the copy sheet and being repelled thereby. Another approach is to employ alternate convergent electrical fields for effecting transfer. The period of the alternating convergent electric field is shorter than the relaxation time of the copy sheet and greater than the relaxation time of the charge conductive particles.

It is, therefore, evident that there has been provided, in accordance with the present invention, an apparatus for preventing charge exchange between the copy sheet and the charged conductive particles being transferred thereto. In this manner, the charged conductive particles are not repelled from the copy sheet and are transferred thereto in image configuration. The apparatus of the present invention fully satisfies the objects, aims and advantages hereinbefore set forth. While this invention has been described in conjunction with specific embodiments thereof, it is evident that many alternatives, modifications, and variations will be apparent to those skilled in the art. Accordingly, it is intended to embrace all such alternatives, modifications and variations as fall within the spirit and broad scope of the appended claims.

What is claimed is:

1. A reproducing machine, including:

a particle receiving member;

means for depositing charged conductive particles on said receiving member in image configuration wherein said depositing means deposits the charged particles on said receiving member in a first time interval; and means for transferring the particles from said receiving member to a copy sheet in a second time interval less than the first time interval so as to control the charge exchange between the particles and the sheet to prevent repulsion of the particles from the sheet during the transfer of the particles thereto.

2. A machine as recited in claim 1, wherein:

said depositing means includes a first roller having a first diameter; and said transferring means includes a second roller having a second diameter less than the first diameter.

3. A machine as recited in claim 1, wherein said transferring means includes:

a movable porous belt supporting the copy sheet; and a corona generator arranged to spray ions through said belt onto the backside of the copy sheet, said corona generator being located closely adjacent to a position wherein said belt spaces the copy sheet from said receiving member.

4. A machine as recited in claim 1, wherein said transferring means includes:

a roller comprising a plurality of electrically conductive segments with each segment being electrically insulated from adjacent segments; and means for electrically biasing successive segments at a location closely adjacent to a position wherein the copy sheet is spaced from said receiving member.

5. A machine as recited in claim 1, wherein said transferring means includes:

a tubular member; and an electrically biased member disposed interiorly of said tubular member and located closely adjacent to a position wherein the copy sheet is spaced from said receiving member.

6. A machine as recited in Claim 1, wherein said transferring means includes:

means for supporting the copy sheet closely adjacent to said receiving member; and means for applying an alternating convergent electric field to said supporting means with the alternating convergent electric field having a time period less than the time constant of the copy sheet and greater than the time constant of the particles.

7. A machine as recited in claim 6, wherein said supporting means includes:

a conductive roller having a roughened exterior surface coupled to said field applying means; and a dielectric resilient layer secured to the exterior surface of said roller.

8. A reproducing machine, including:

a particle receiving member;

means for depositing charged conductive particles on said receiving member in image configuration; and means for transferring the particles from said receiving member to a copy sheet with the charge exchange between the particles and the sheet being controlled to prevent repulsion of the particles from the sheet during the transfer of the particles thereto, said transferring means comprising means for supporting the copy sheet closely adjacent to said receiving member, said supporting means comprising a tubular member, a dielectric resilient layer secured to the outer circumferential surface of the tubular member, and a plurality of spaced conductive rods positioned in said resilient layer, and means for applying an alternating convergent electric field to said supporting means with the alternating convergent electric field having a time period less than the time constant of the copy sheet and greater than the time constant of the particles.

9. An electrophotographic printing machine of the type having an electrostatic latent image recorded on a photoconductive member, wherein the improvement includes;

means for depositing charged conductive particles on the electrostatic latent image recorded on the photoconductive member wherein said depositing means deposits the charged particles on the photoconductive member in a first time interval; and means for transferring the particles from the photoconductive member to a copy sheet in a second time interval less than the first time interval so as to control the charge exchange between the particles and the sheet to prevent repulsion of the particles from the sheet during the transfer of the particles thereto.

10. A printing machine as recited in claim 9, wherein:

said depositing means includes a first roller having a first diameter; and said transferring means includes a second roller having a second diameter less than the first diameter.

11. A printing machine as recited in claim 9, wherein said transferring means includes:

a movable porous belt supporting the copy sheet; and a corona generator arranged to spray ions through said belt onto the backside of the copy sheet, said corona generator being located closely adjacent to a position wherein said belt spaces the copy sheet from the photoconductive member.

12. A printing machine as recited in claim 9, wherein said transferring means includes:

a roller comprising a plurality of electrically conductive segments with each segment being electrically insulated from adjacent segments; and means for electrically biasing successive segments at a location closely adjacent to a position wherein the copy sheet is spaced from the photoconductive member.

13. A printing machine as recited in claim 9, wherein said transferring means includes:

a tubular member; and an electrically biased member disposed interiorly of said tubular member and located closely adjacent to a position wherein the copy sheet is spaced from the photoconductive member.

14. A printing machine as recited in claim 9, wherein said transferring means includes:

means for supporting the copy sheet closely adjacent to the photoconductive member; and means for applying an alternating convergent electric field to said supporting means with the alternating convergent electric field having a time period less than the time constant of the copy sheet and greater than the time constant of the particles.

15. A printing machine as recited in claim 14, wherein said supporting means includes:

a conductive roller having a roughened exterior surface coupled to said field applying means; and a dielectric resilient layer secured to the exterior surface of said roller.

16. An electrostatographic printing machine of the type having an electrostatic latent image recorded on a photoconductive member, wherein the improvement includes:

means for depositing charged conductive particles on the electrostatic latent image recorded on the photoconductive member; and means for transferring the particles from the photoconductive member to a copy sheet with the charge exchange between the particles and the sheet being controlled to prevent repulsion of the particles from the sheet during the transfer of the particles thereto, said transferring means comprising means for supporting the copy sheet closely adjacent to the photoconductive member, said supporting means comprising a tubular member, a dielectric resilient layer secured to the outer circumferential surface of said tubular member, and a plurality of spaced conductive rods positioned in said resilient layer, and means for applying an alternating convergent electric field to said supporting means with the alternating convergent electric field having a time period less than the time constant of the copy sheet and greater than the time constant of the particles.

* * * * *